United States Patent [19]

Davis

[11] Patent Number: 4,828,259

[45] Date of Patent: May 9, 1989

[54] TENNIS RACQUET WITH DOUBLE THROAT BRIDGE

[75] Inventor: Stephen J. Davis, New Hope, Pa.

[73] Assignee: Prince Manufacturing, Inc., Lawrenceville, N.J.

[21] Appl. No.: 178,299

[22] Filed: Apr. 6, 1988

[51] Int. Cl.[4] ..... A63B 49/06

[52] U.S. Cl. ..... 273/73 C; 273/73 G

[58] Field of Search ..... 273/73 R, 73 C, 73 D, 273/73 F, 73 G, 73 H, 73 L

[56] References Cited

U.S. PATENT DOCUMENTS

| | | | |
|---|---|---|---|
| 3,642,283 | 2/1972 | Wilkens | 273/73 G |
| 3,908,995 | 9/1975 | Portz | 273/73 G |
| 4,290,604 | 9/1981 | Held | 273/73 G |
| 4,765,620 | 8/1988 | Janes | 273/73 G |

FOREIGN PATENT DOCUMENTS

| | | | |
|---|---|---|---|
| 2621062 | 12/1978 | Fed. Rep. of Germany | 273/73 G |

*Primary Examiner*—Richard C. Pinkham
*Assistant Examiner*—William E. Stoll
*Attorney, Agent, or Firm*—Brumbaugh, Graves, Donohue & Raymond

[57] ABSTRACT

A sports racquet, for example for tennis, includes a main frame member defining a head portion, a throat area, and a shaft portion. A throat bridge spans the opposed legs of the main frame member in the throat area to define, with the head portion, an enclosed area for supporting strings. The throat bridge includes a pair of upper and lower bridge sections which extend generally transversely and are spaced apart longitudinally to define a cutout area therebetween. A piece of vibration absorbing material is positioned between the upper and lower bridge sections. The upper and lower bridge sections and vibration absorbing piece have aligned holes for receiving strings. At least some of the longitudinal racquet strings extend through aligned holes through the upper and lower bridge pieces and vibration absorbing material, such that the strings are supported by the lower bridge piece, and are in contact with the vibration absorbing material, which lies between opposite support points of strings to dampen vibration. The defined structure also substantially reduces racquet vibration.

7 Claims, 4 Drawing Sheets

TENNIS RACQUET WITH DOUBLE THROAT BRIDGE

FIELD OF THE INVENTION

The present invention relates to sports racquets of the type having a handle and a head portion with strings, for example, tennis racquets, and specifically to a new vibration dampening structure for the frame of such a racquet.

BACKGROUND OF THE INVENTION

Some of the more popular tennis racquet frames available today are made of fiber-impregnated resins, e.g. graphite, which are formed as tubular stock and shaped and cured in a heated mold. The tubular member is bent in the mold to define an elliptical head portion, and the opposite free ends of the tubular member then converge to form a throat area and a shaft portion that supports a handle. A bridge extends between the tubular sides in the throat area, to enclose the head portion and form an area which supports strings.

The impact of the ball upon the racket strings causes the strings and frame to deflect, thereby imparting vibration to the frame. Vibration in the racquet is undesirable and, as a result, there have been many proposals to modify the basic tennis racquet frame to attempt to reduce or more quickly dampen vibration.

One approach to this problem has been to fill the core of the racquet frame with a vibration dampening material. An example is disclosed in Fernandez et al. U.S. Pat. No. 4,413,822, in which the core or a tubular racquet frame is filled with an elastic polymer. In reality, foam cores often produce little in the way of vibration dampening. Moreover, if higher densities are used, such as needed in Fernandez, the core adds significantly to the weight of the racket.

Yuhas et al. U.S. Pat. No. 4,634,124 discloses a sports racquet in which an elastomeric dampening material is interposed between the throat piece and the adjoining legs of the frame. The dampening pieces are relatively thin and also are fastened to the frame, and thus it appears that the vibration dampening capability is limited. Yuhas also proposes, in an alternative embodiment, to reduce the vibration of the strings. In this embodiment, the strings bear against nubs of elastomeric dampening material. However, the nubs are at the support point for the strings, and thus the degree to which they can reduce string vibration is limited.

An effective vibration dampening structure for graphite and similar tubular racquet frames is disclosed in commonly owned U.S. patent application Ser. No. 049,775, filed May 12, 1987, and since abandoned. The tennis racket frame is a tubular sandwich construction in which a visco-elastic dampening sleeve is disposed between inner and outer tubular frame members of fiber-impregnated resins. With vibrating movements, opposed surfaces of the inner and outer tubular members deflect by different amounts, which is taken up in the sleeve to quickly dissipate vibration energy.

While some of the known measures do reduce racquet vibration, it would be desirable to utilize other structural features that will reduce frame vibrations further. Also, it would be desirable to provide structure that will effectively reduce vibration in the strings.

SUMMARY OF THE INVENTION

The present invention is a sports racquet, for example a tennis racquet having a tubular frame, preferably of fiber-impregnated resin material, that provides improved vibration dampening characteristics not just in the frame but also in the strings.

More particularly, a tennis racquet according to the invention includes a main frame member defining a head portion, a throat area, and a shaft portion; a throat bridge spanning opposed legs of the main frame member in the throat area; a handle on the shaft portion; and strings supported under tension by the head portion and throat bridge. The throat bridge comprises a pair of upper and lower, generally transversely extending, longitudinally spaced, bridge sections that define a transversely extending, elongated slot therebetween. A piece of vibration absorbing material is positioned between the upper and lower bridge sections in contact therewith. At least some of the racquet strings extend through aligned holes in the upper and lower bridge sections and vibration dampening piece and are supported in tension by the lower bridge section.

Preferably, the vibration dampening piece is made of a relatively soft elastic material, such as a polyvinyl chloride elastomer or a polyurethane foam. Preferably the bridge pieces and slot are of approximately of equal width and are arcuate, with the slot area being centered about the longitudinal racquet axis. The strings may bear against grommets in the lower bridge piece, but preferably such grommets do not extend into the cutout area or upper bridge piece, so that the vibration absorbing piece contacts the strings directly.

For a better understanding of the invention, reference is made to the following detailed description of a preferred embodiment, taken in conjunction with the drawings accompanying the application.

DETAILED DESCRIPTION OF A PREFERRED EMBODIMENT

Figure 1:
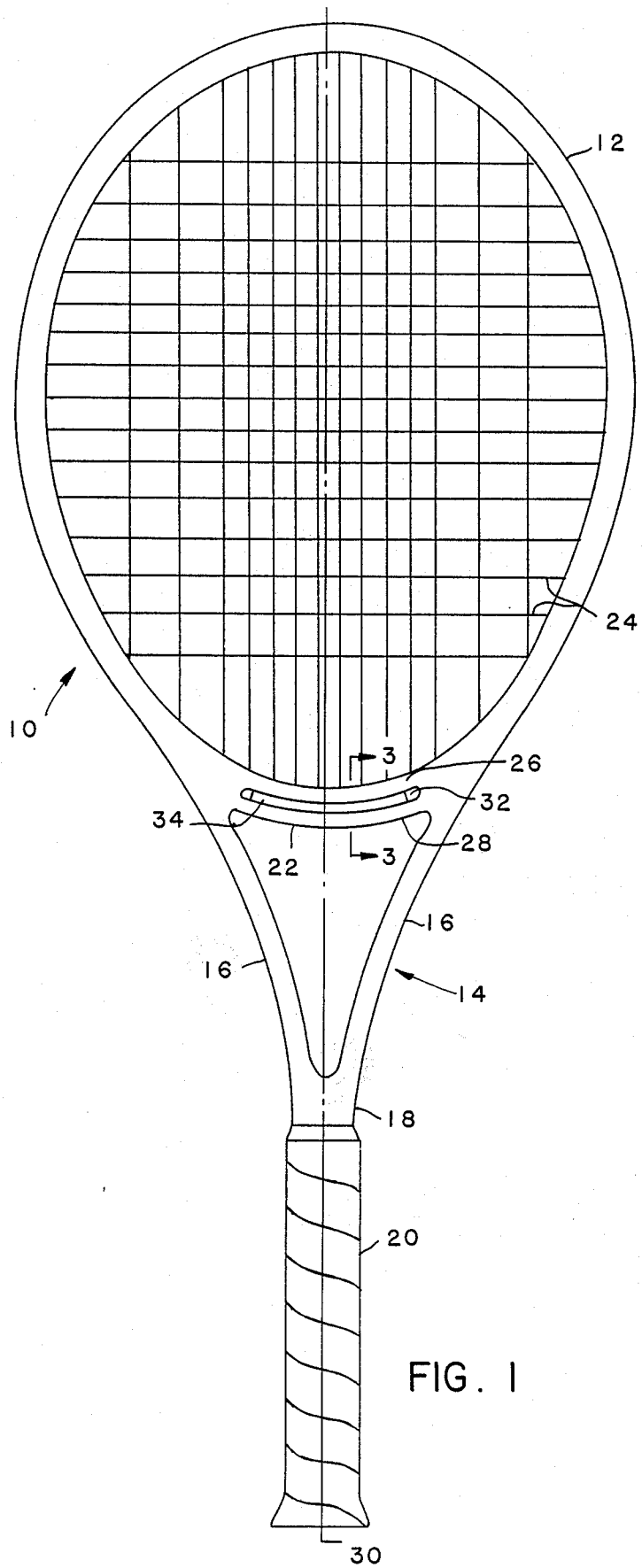
FIG. 1 is a front view of a tennis racquet according to the invention.

A tennis racquet according to the invention includes a main frame member 10 formed from an elongated tubular member, preferably a fiber-impregnated resin such as graphite. The tubular member is shaped to define a head portion 12 of generally elliptical configuration, with the opposite, free ends 16 of the tubular member converging into a throat area 14 and joining to form a shaft portion 18. A handle 20, which may be made of leather or other suitable material, is mounted on the shaft portion 18 of the main frame member 10. Finally, a throat bridge 22 spans the throat area of the racquet between the opposed legs 16, such that the throat bridge 22 and head portion 12 define an enclosed area for supporting strings. For purpose of illustration, a number of transverse and longitudinally extending strings 24 are shown in FIG. 1 connected to the head portion 12 and throat piece 22. Although the strings 24 are referred to plurally, as is known the vertical and cross strings are normally one or more continuous strings. The actual number and spacing of the strings may be selected as desired, in accordance with known principles.

Instead of a conventional throat bridge, as shown in FIG. 1 a racquet according to the present invention has a double throat bridge 22 comprising an upper bridge section 26 and a lower bridge section 28 which are spaced longitudinally from one another and extend generally transversely to the frame axis 30. The upper and lower bridge sections 26, 28 define a slot 32 therebetween in which a piece of vibration absorbing material 34 is positioned as described further below.

Figure 2:
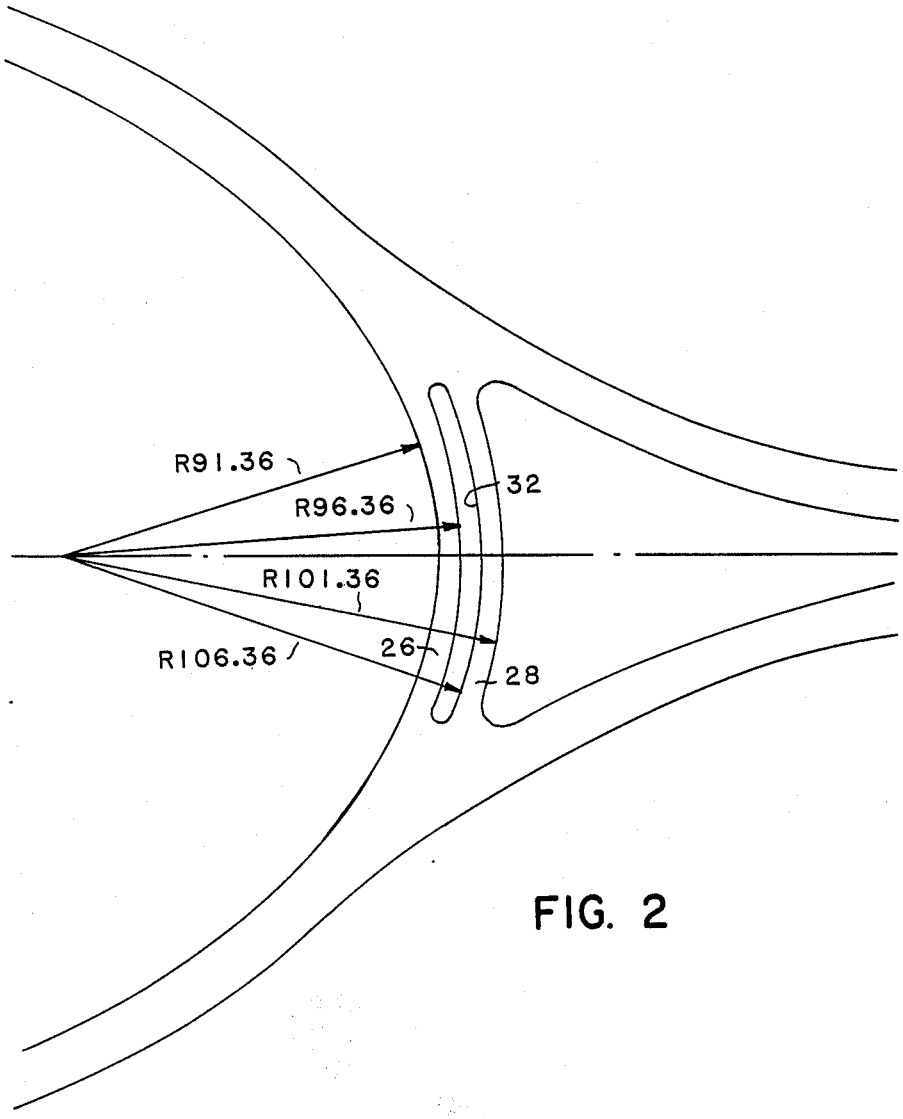
FIG. 2 is an enlarged front view of the throat area of the racquet shown in FIG. 1.

FIG. 2 is an enlarged view of the throat area of FIG. 1, in which the strings have been omitted for clarity. As shown, the slot 32, upper bridge section 26, and lower bridge section 28 are each generally arcuate. Slot 32 is preferably centered about the axis 30. In the embodiment shown, the slot 32 extends transversely about 75% the width of the frame at the adjoining throat area. The transverse width of slot 32 as shown is an exemplary arrangement for the illustrated frame geometry and string spacing, but other widths may be utilized. Preferably also, the slot 32 height (in the axial direction) is equal to the thickness of the two bridge sections. By way of example, the upper and lower sections 26, 28 may each have a thickness of 5 millimeters, the space between the sections, defining the slot 32, also being 5 millimeters In a preferred embodiment, the main frame member has a height of about 23 mm, whereas the upper and lower bridge sections 26, 28 have a height, transverse to the string plane, of about 15 mm. However, the height of the bridge pieces may be varied so as to be larger, smaller, or the same size as the rest of the frame.

Figure 3:
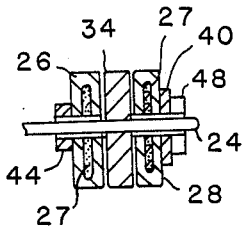
FIG. 3 is a sectional view, taken through lines 3—3 of FIG. 2.

FIG. 3 illustrates an exemplary composition of the upper and lower bridge pieces 26, 28, which are formed in a similar manner. Each bridge piece includes a generally rectangular, internal core element 27, about which strips of fiber-impregnated resin are wrapped. The core elements 27 may be of an expandable foam, according to known techniques, so as to pressurize the bridge sections during molding.

Figure 4:
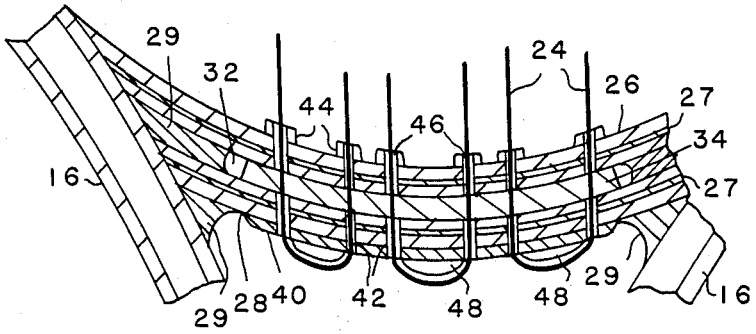
FIG. 4 is a top, sectional view of the bridge piece.

Referring to FIGS. 3 and 4, a grommet strip 40 is placed over the lower side of the lower bridge piece 28. The grommet piece 40 includes tubular legs 42 that extend into holes formed in the lower bridge piece 28. The legs 42 preferably do not extend into the slot 32. A plurality of holes are formed in the upper bridge piece 26 for the strings to pass. Optionally, a plurality of guide pegs 44, also having tubular leg portions 46, are inserted in the holes. The legs 46 stop short of the slot area 32, so that neither the pegs 44 nor the grommet 40 project into that area.

Holes are provided in the upper and lower bridge pieces 26, 28 so that the pegs 44 are aligned with corresponding legs of the grommet strip 40 to provide a string passage. Smaller holes, just large enough to thread the strings, are formed in the vibration absorbing member 34, which holes are aligned with respective pegs 44 and grommet legs 42, and as is shown in FIGS. 3 and 4, the strings 24 are directed through aligned pegs 44 and grommet legs 42 passing through the vibration absorbing piece 34. The strings are directed through a pair of aligned legs of the grommet and the peg, about an arcuate bearing surface 48 on the grommet, and through the aligned pair of adjoining legs.

The main frame member 12 may be formed according to known processes, in which sheets of fiber-impregnated resin are rolled to form a tubular layup, which is then placed in a mold shaped in the general shape of a frame. Prior to heating and curing the main frame member 12 in the mold, the pre-formed upper bridge section 26 and lower bridge section 28 are positioned in the mold, and positioned as shown in FIG. 4 so as to extend between the legs 16 of the main frame member. Thereafter, reinforcing strips 29, shown in FIG. 4, are arranged in the mold. The use of reinforcing strips in the area where a bridge piece joins the main frame member is well known and therefore need not be described further here. Between the bridge pieces 26, 28, reinforcing strips 29 are used to define the ends of slot area 32. By example, the slot 32 may be given a transverse width of 80 mm, the racquet frame having a width, at such axial position of 120 mm.

With the preformed double throat bridge pieces and reinforcing strips of fiber-impregnated resin in place in the mold, the frame is heated and molded under internal pressurization to conform to the mold in a technique which is known. As noted above, by using foam cores 27 in the bridge pieces 26, 28, such cores provide internal pressurization to the bridge sections 26, 28 during molding.

Once the frame member is heated and cured in the mold, handle 20 is formed on the shaft portion 18 of the main frame member, and holes are formed in the racquet frame for strings, as is customarily done. As noted above, string holes in the area of the bridge piece are formed through both the upper and lower bridge sections 26, 28.

Prior to stringing, the vibration absorbing piece 34, is inserted between the upper and lower bridge sections 26, 28, and grommet piece 40 and pegs 44 are inserted in the stringing holes as shown in FIG. 4. Also, preferably the head portion 12 of the main frame member is provided with an outwardly facing stringing groove, and one or more grommet strips are inserted into the stringing grooves. The use of grommet strips is well known and need not be described further.

Holes in the piece 34 are made just slightly larger than the strings, so that the strings may be threaded freely through the holes in the bridge and vibration absorbing piece 34. Although there is initially some clearance between the holes in the vibration absorbing material 34 and strings, once the strings are tightened on the racquet, the lower bridge piece 28 is pulled, by the tension of the strings, towards the upper bridge piece 26, which compresses the vibration absorbing piece 34, so that the strings are in firm contact with the piece 34.

Because the strings are anchored only in the lower bridge piece, and not the vibration absorbing piece or upper bridge piece, the tension support point is in the lower bridge piece 28. The strings pass through the vibration absorbing material which is located inwardly from the support point. Since the vibration absorbing piece engages the string at a point between the opposite supports of the string, it dampens vibration very quickly.

As shown by FIG. 4, opposite ends of the upper and lower bridge sections 26, 28 bear against opposite sides of the main frame member. Because the pieces are longitudinally spaced from one another, deflection of the racquet frame produces different movement in the sections 26, 28, the shifting producing a shearing action between the facing surfaces of the section that is imparted to the vibration absorbing piece 34, thereby damping vibration. Providing this vibration attenuation in the bridge is particularly effective, since the bridge contacts both sides of the frame and therefore receives any frame vibration. As noted above, in a preferred embodiment the height of the bridge sections 26, 28 is less than the main frame profile. This has the effect of making the bridge relatively more flexible, and thus frame deformation is concentrated more in the bridge area, so that the damping action of the bridge can produce the most effect.

A racquet constructed according to the invention, constructed with a graphite frame, was compared for vibration dampening characteristics with a racquet which was identical in construction, except without the vibration absorbing material. In other respects, the racquets were the same, and were strung to the same tension on the same stringing machine.

The racquets were tested sequentially for frame vibration, by impacting a tennis ball against the racquet in identical locations lying approximately at the top third of the string plane. An accelerometer was used to measure vibration amplitude verses time, which was recorded on a spectrum analyzer.

Figure 6:
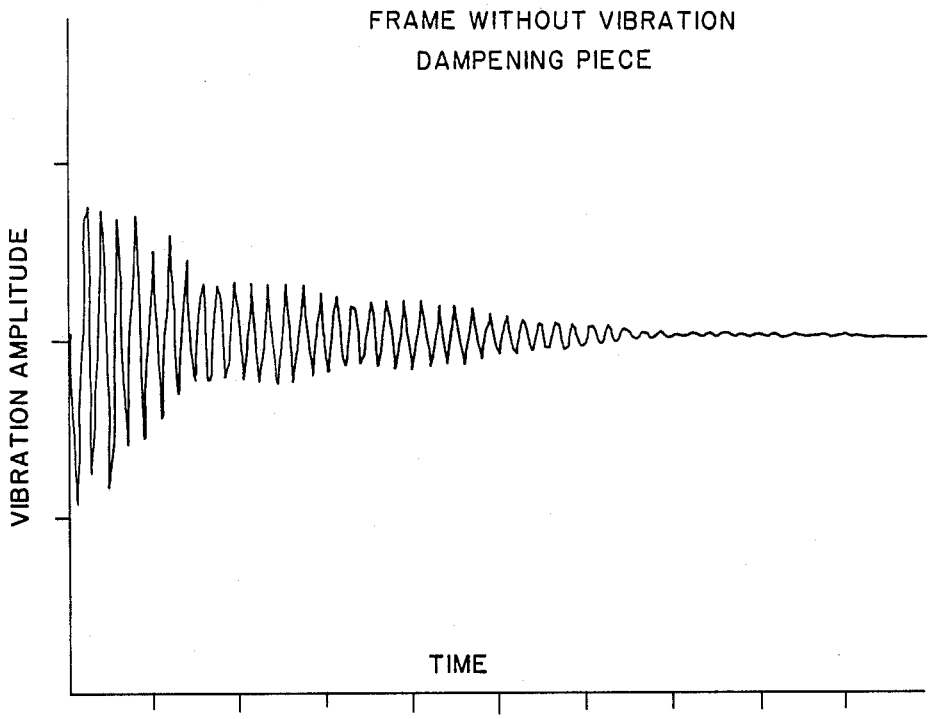
FIGS. 5–6 are graphs comparing the vibration characteristics of a racquet according to the invention with a conventional racquet.
Figure 5:
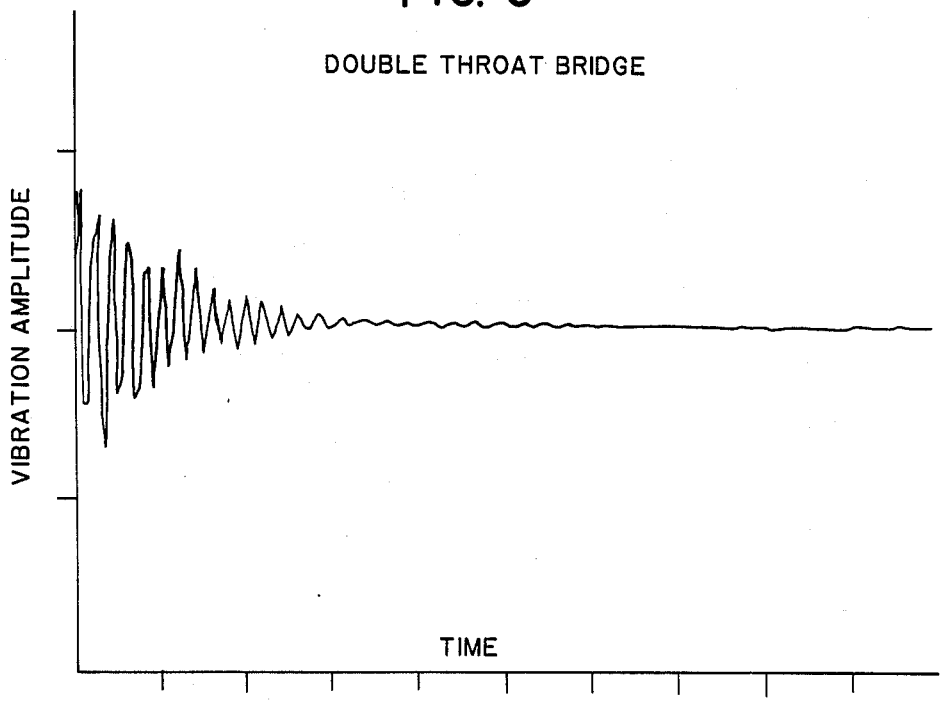

FIG. 6 is a graph showing displacement verses time for the racquet without the vibration absorbing piece. FIG. 5 is a similar graph for a graphite racquet which includes the vibration absorbing piece between the double throat bridge. In each case, the initial amplitude of vibration is approximately the same; however the vibration in the racquet according to the invention dissipates in approximately 0.1191 seconds verses 0.2422 seconds for the conventional racquet, providing approximately a 50% improvement in vibration damping of the frame.

Testing was also conducted to measure vibration dampening of the strings. While such vibration is more difficult to measure with full accuracy, tests indicated a 7–12% improvement in vibration dampening occurs with the double throat bridge.

The foregoing represents a preferred embodiment of the invention. Variations and modifications of the structure shown and described will be evident to persons skilled in the art, without departing from the inventor principles disclosed herein. For example, while a split frame section and vibration absorbing piece are shown in the throat area, it is possible to employ such structure in other areas of the frame, such as the tip of the racquet, either alone or together with the double throat bridge. All such modifications and variations are intended to be within the scope of the invention, as defined in the following claims.

I claim:

1. A sports racquet having a longitudinal axis, comprising:

a main frame member having a head portion, a throat portion defined by opposite legs of the frame member, and a shaft portion;

a throat bridge spanning the opposed legs of the main frame member in the throat area, wherein the throat bridge comprises a pair of upper and lower, generally transversely extending, longitudinally spaced bridge sections that extend between said opposed legs, defining a transversely extending slot area;

a piece of vibration absorbing material positioned in the slot area between the upper and lower bridge sections; wherein the upper and lower sections and vibration absorbing piece include aligned holes for receiving strings; and a plurality of strings supported under tension by the head portion and throat bridge, wherein at least some of the strings pass through aligned holes in the upper and lower bridge portions and vibration absorbing piece, and are supported in tension by the lower bridge piece.

2. A sports racquet according to claim 1, wherein the slot area and the upper and lower bridge sections are arcuate.

3. A sports racquet as defined in claim 2, wherein the vibration absorbing piece is a piece of soft elastomer material which is in contact with the upper and lower bridge sections.

4. A sports racquet as defined in claim 2, wherein the slot area extends transversely about 75% of the width of the corresponding frame section.

5. A sports racquet as defined in claim 4, wherein the slot area has a height approximately equal to the thickness of the upper and lower bridge sections.

6. A sports racquet as defined in claim 2, wherein the bridge sections have a height, transverse to the string plane, which is less than the main frame member.

7. A sports racquet comprising:

a frame having a head portion defining an enclosed area for supporting strings and a shaft portion for supporting a handle; and strings supported by said head portion; wherein said head portion includes at least one elongated section defined by a pair of spaced frame profile members defining a slot therebetween, including an outer profile member and an inner profile member, and comprising a piece of vibration absorbing material disposed between said profile members and in contact therewith, and wherein strings extend through aligned holes in said profile members and vibration absorbing piece and are supported by said outer profile member.

* * * * *